United States Patent [19]

Kaiser

[11] Patent Number: 4,464,991

[45] Date of Patent: Aug. 14, 1984

[54] SAFETY DEVICE FOR FUSES OF SPINNING PROJECTILES

[75] Inventor: Hans Kaiser, Konigsfeld, Fed. Rep. of Germany

[73] Assignee: Gebruder Junghans GmbH, Schramberg, Fed. Rep. of Germany

[21] Appl. No.: 345,761

[22] Filed: Feb. 4, 1982

[30] Foreign Application Priority Data

Feb. 26, 1981 [DE] Fed. Rep. of Germany ..... 3107110

[51] Int. Cl.[3] ..... F42C 15/22

[52] U.S. Cl. ..... 102/233; 102/235; 102/255

[58] Field of Search ..... 102/233, 232, 231, 235, 102/238, 254, 255, 222, 234

[56] References Cited

U.S. PATENT DOCUMENTS

| | | | |
|---|---|---|---|
| 2,718,850 | 9/1955 | Kuhn | 102/238 |
| 3,162,126 | 12/1964 | Weber et al. | 102/249 |
| 3,465,676 | 9/1969 | Simmen | 102/233 |
| 3,670,655 | 6/1972 | Krupa | 102/238 |
| 3,777,666 | 12/1973 | Morel | 102/233 |
| 4,128,061 | 12/1978 | Kaiser | 102/251 X |
| 4,195,575 | 4/1980 | Deuker et al. | 102/235 X |

FOREIGN PATENT DOCUMENTS 3015424 10/1981 Fed. Rep. of Germany .

*Primary Examiner*—David H. Brown

*Attorney, Agent, or Firm*—Burns, Doane, Swecker & Mathis

[57] ABSTRACT

A fuse for a spinning projectile comprises a rotor having safety elements which prevent rotation of the rotor to an active position. The safety elements are arranged such that when the safety elements are properly installed, the center of gravity of the rotor induces rotation of the rotor in a first direction toward the active position. An escapement mechanism regulates the rate of rotation of the rotor in such first direction. A stop prevents rotation of the rotor in the opposite direction. When a safety element is missing, the center of gravity is positioned to induce rotation of the rotor in such opposite direction in which the rotor cannot rotate.

8 Claims, 4 Drawing Figures

SAFETY DEVICE FOR FUSES OF SPINNING PROJECTILES

BACKGROUND AND OBJECTS OF THE INVENTION

The invention concerns a safety device for fuses of spinning projectiles of the type in which two recoil bolts are releasable from a locked condition to permit rotation of a detonator after firing has occurred.

A safety device for fuses of projectiles without spin or with a slight spin is known. This safety device consists essentially of two recoil bolts secured by a ball detent in the safety position. If one of the safety elements, for example, one of the recoil bolts, is missing, the rotor is intended to be permanently arrested in the safety position by means of a spring-loaded latch. This, however, may not be adequate, since such a spring-loaded latch may be released from its anchoring with the rotor by transport impacts or the like.

It is thus an object of the invention to provide a fuse safety device acting upon the firing of a spinning projectile, which if the safety elements are installed correctly, will eliminate the break in the ignition sequence and will activate the fuse, but will prevent the activation of the fuses in the case of incorrectly mounted safety elements.

SUMMARY OF THE INVENTION

This object is attained in accordance with the present invention by means of an apparatus and method of assuring a safe operation of a fuse for a spinning-type projectile. The fuse comprises a rotatably mounted rotor including a carrier for a detonator, and a safety assembly on the carrier. The carrier is movable in a first direction of rotation to bring the detonator to an active position, but is incapable of doing so in the opposite direction of rotation. The safety assembly is arranged to prevent rotation of the rotor in the first direction until the projectile has been fired. The safety assembly comprises a recoilable safety bolt element, a movable detent element, and a spring-biased retainer element. The recoilable safety element prevents the rotor from rotating in the first direction and is movable to a release position in response to firing of the projectile to release the rotor for rotation induced by motion of the projectile. The spring-biased retainer element urges the detent element into retaining engagement with the safety bolt element to retain the latter in its released position. The safety assembly is arranged such that when the elements are properly installed, a center of gravity of the rotor is positioned to induce rotation of the rotor in the first direction in response to projectile motion. On the other hand, when at least one of the elements of the safety assembly is missing, the center of gravity is positioned to induce rotation of the rotor in the opposite direction, in which it is incapable of bringing the detonator to its active position.

Preferably, the rotor is prevented from bringing the detonator to its active position in the opposite direction of rotation by means of a stop.

Preferably, an imaginary plane containing the spaced axes of rotation of the rotor and the fuse divides the rotor into first and second sections. The center of gravity of the rotor is disposed in the first section when the elements are properly installed and are disposed in the second section when one of the elements is missing.

Safety is provided for the case when an assembly error remains unnoticed. Bursting in the bore or projectile disintegration within the safety range in front of the barrel are prevented, as the rotor remains in the "safe" position. The position of the gravity center of the rotor is decisive for the direction of rotation of the rotor and for the retention of the rotor in the safety position, respectively. The simple solution, whereby the location of the gravity center of the rotor is used as a safety criterion, is surprising. In the case of a correctly mounted safety system, the gravity center of the rotor will effect its activation by means of projectile spin, while with a defective safety system the position of the gravity center of the rotor is such that the securing (non-activation) of the rotor is insured.

THE DRAWING

An example of embodiment of the invention is described in the drawing wherein.

DETAILED DESCRIPTION OF A PREFERRED EMBODIMENT OF THE INVENTION

Figure 1:
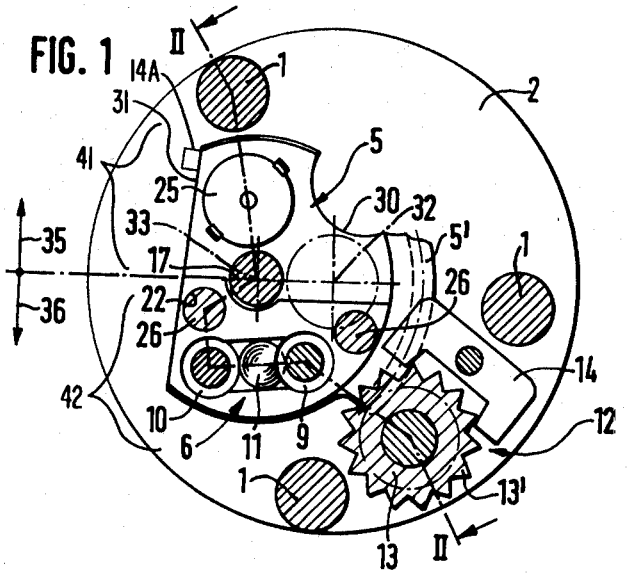
FIG. 1 shows a cross-sectional view of a fuse taken along line I—I in FIG. 2.
Figure 2:
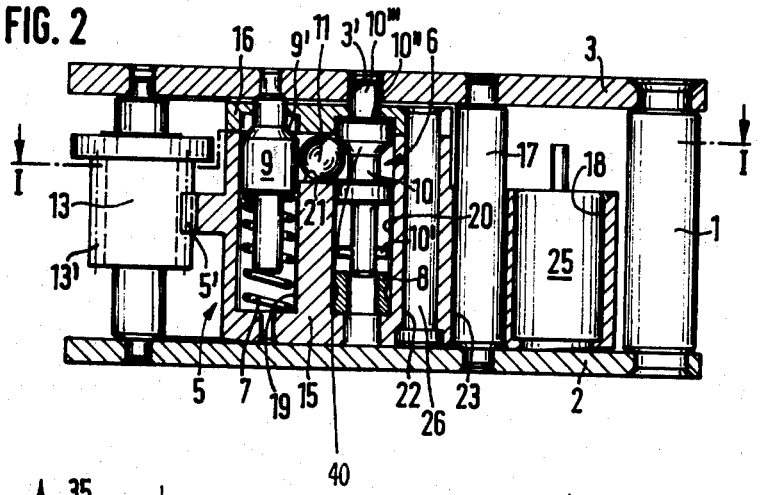
FIG. 2 is a longitudinal sectional view through the fuse taken along line II—II.

A fuse according to the invention includes two plates 2, 3, connected with each other by column 1. The rotor 5 comprises a carrier housing 15 and a cover 16 joined together by pins 26. The rotor carries a shaft 17, the ends of which are supported in the plates 2 and 3 to mount the rotor for rotation relative to the plates 2, 3 about an axis 33 defined by the shaft 17. Disposed in the rotor are a plurality of recesses 18–23. A first of the recesses 18 receives a standard detonator 25. A second recess 19 receives a retainer bolt 9 and a spring 7 biasing the bolt toward the plate 3.

Figure 3:
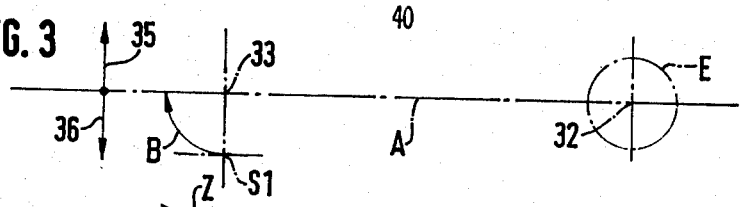
FIGS. 3 and 4 are schematic representations of the fuse with respect to the position of its centers of rotation and gravity.

A third recess 20 receives a safety bolt 10. In a fourth recess 21 there is positioned a ball detent 11. The fourth recess 21 interconnects the second and third recesses 19, 20 such that in a safety condition of the fuse the ball 11 bears against a conical surface 40 of the safety bolt to retain the bolt in a safety position in which an end lug 10''' of the safety bolt engages a bore 3' of the plate 3. In such a condition the fuse is incapable of rotation about its axis of rotation 33. Accordingly, the detonator 25 cannot travel to its customary detonation position E (FIG. 3) which is aligned with the axis of rotation and main axis 32 of the fuse (FIGS. 1, 3).

The bolts 9, 10, the ball 11, the spring 7, etc., form elements of a safety assembly 6 carried by the rotor.

The remaining recesses 22, 23 in the rotor house the afore-described pins 26 and the shaft 17.

A conventional speed retarding mechanism 12 is provided which includes an escapement wheel 13 mounted between the plates 2, 3. A toothed segment 5' of the rotor 5 engages the teeth 13' of the wheel 13 so that rotation of the rotor is regulated by the wheel 13 and its oscillatory bar 14. Rotation of the rotor 5 is permitted in only one direction (clockwise in FIG. 1), i.e., that normally encountered in a properly assembled fuse. An appropriately positioned stop 14A provided on the plate 2 prevents any such reverse rotation. Alternatively, the stop could be disposed such that it prevents sufficient rotation to bring the detonator to an active position. In other words, the rotor or carrier 5 is prevented from bringing the detonator to its active position in the reverse direction of rotation (i.e., counterclockwise as seen in FIG. 1).

On its periphery the rotor 5, 15 has a curved pocket 30 and a flat section 31.

Figure 4:
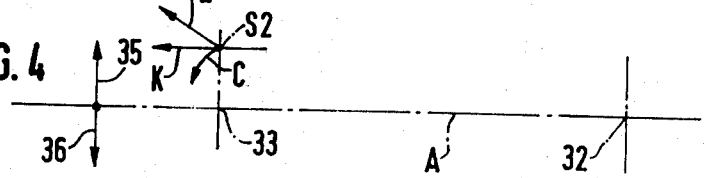

The axis of rotation, i.e., the principal longitudinal axis, 32 of the fuse is depicted in FIGS. 3 and 4 along with the rotary axis 33 of the rotor 5. A connecting plane A between the rotating axis 32 of the fuse and the rotating axis 33 of the rotor 5 divides the rotor into two sections in the direction of arrows 35, 36 (FIGS. 3, 4). That is, a first section 41 of the rotor extends from the imaginary plane A in the direction of the arrow 35, and a second section 42 of the rotor extends from the imaginary plane A in the direction 36.

The detonator 25 is arranged in the first section 41. The safety system 6, together with the pins 26 of the rotor 5 are located in the second section 42.

When the safety system, e.g., bolts 9, 10, ball 11, spring 7, are properly mounted, the center of gravity S1 of the rotor 5 (see also FIG. 3) is located in the second section 42. If by mistake a part of the safety system, e.g., a bolt 9 or 10, or the ball 11, had not been installed, the gravity center of the rotor 5 would be located in the first section 41 (see FIG. 4).

For example, if the entire safety system is omitted, a displaced center of gravity S2 exists in the first section 41 (FIG. 4). If only the ball 11 were omitted, the displaced center of gravity would still be located in the first section 41, but would be closer to the connecting plane A.

OPERATION of the fuse and safety system will be explained, firstly, assuming a correct installation of the safety elements. The retainer bolt 9 is moved toward the plate 2 by the firing acceleration of the projectile (not shown). The translational acceleration acting on the safety bolt 10 urges the ball 11 against a conical surface 9' of the retainer bolt 9. The safety bolt then travels toward the plate 2 until a shear pin 10' is sheared off a bushing 8. The spring 7 presses against the conical surfance 9' and thus presses the ball 11 against a shoulder 10'' of the safety bolt 10 to arrest the safety bolt system 6 in the activated position. The rotor 5 is unlocked since the lug 10''' of the safety bolt 10 has been removed from the bore 3' of the plate 3. The rotor 5 is thus characterized by a gravity center S1 in the second section 42 (FIG. 3) and is subjected to the torque generated by centrifugal forces. As a result, the rotor turns in the direction of the arrow B until the rotor 5, delayed by the escapement 13, reaches the "active" position with the detonator 25 in position E indicated by broken lines in FIG. 1.

However, if one of the bolts 9, 10 or even both of them, including the ball 11, are mistakenly omitted, then according to FIG. 4, a displaced gravity center S2 exists. If it is assumed that the rotor 5 is in the depicted safety position when the projectile is fired, then the centrifugal force Z generated by the projectile spin retains the rotor in the safety position, since the force K acting upon it causes a rotation in the direction of the arrow C. However, the rotor 5 would be blocked by the stop 14A and could not rotate in that direction.

It will be appreciated that by assuring that the gravity center of the rotor 5 is always within the first section 41 when one of the parts of the recoil bolt system 6 is missing, the detonator 25 will remain in its "safe" position shown in FIG. 1. It is thus impossible to ignite the fuse.

Although the invention has been described in connection with a preferred embodiment thereof, it will be appreciated that modifications, substitutions, deletions and additions made by made by those skilled in the art without departing from the scope or spirit of the invention as defined in the appended claims.

I claim:

1. A fuse for a spinning-type projectile, the fuse comprising a rotatably mounted rotor including:

a rotatably mounted carrier for a detonator, said carrier being movable in a first direction of rotation for bringing said detonator to an active position for detonation, means for preventing said rotor from bringing said detonator to said active position in the opposite direction of rotation, a safety assembly on said carrier for preventing rotation of said rotor in said first direction until the projectile has been fired, said safety assembly comprising:

a displaceable safety bolt element for preventing said rotor from rotating in said first direction, said safety bolt element being movable to release position in response to firing of the projectile to release said rotor for rotation in said first direction induced by motion of the projectile, a movable detent element, and a spring-biased retainer element for urging said detent element into retaining engagement with said safety bolt element to retain the latter in said release position, said safety assembly being arranged on said carrier such that when said elements are properly installed a center of gravity of said carrier is located to induce rotation of said rotor in said first direction in response to projectile motion, said when at least one of said elements is missing the center of gravity is located to induce rotation of said carrier in the opposite direction.

2. A fuse according to claim 1 including an escapement wheel operably coupled to said carrier to regulate the rate of rotation thereof in said first direction.

3. A fuse according to claim 1, wherein an imaginary plane containing the spaced axes of rotation of said carrier and said fuse divides said carrier into first and second sections, the center of gravity of said carrier being disposed in said first section when said elements are properly installed and in said second section when one of said elements is missing.

4. A fuse according to claim 1, wherein said carrier has a non-circular outer periphery.

5. A fuse according to claim 1, wherein said carrier comprises a housing having a cover to retain said elements therein.

6. A fuse according to claim 1, wherein said retainer element comprises a recoilable retainer bolt displaceable in response to projectile firing to enable said detent element to be displaced by said safety bolt.

7. A fuse according to claim 6, wherein said detent element comprises a ball.

8. A method of assuring safe operation of a fuse for spinning-type projectiles, comprising the steps of:

arranging a detonator carrier for rotation about an axis such that the carrier can bring a detonator carried thereby to an active position for detonation in a first direction of rotation, but not in the opposite direction of rotation, releasably restraining said carrier by the elements of a releasable safety assembly which prevents rotation of said carrier in said first direction until firing of the projectile occurs, at which time said carrier is released for rotation in said first direction under the inducement of projectile motion, and arranging said safety assembly such that when the elements thereof are properly installed, a center of gravity of said carrier is located to induce rotation of said carrier in said first direction whereas when one of the elements is missing, the center of gravity is located to induce rotation of said carrier in said opposite direction of rotation.

* * * * *